US006107964A

United States Patent [19]

Hirabe

[11] Patent Number: 6,107,964

[45] Date of Patent: Aug. 22, 2000

[54] SHAPED BEAM ARRAY ANTENNA FOR GENERATING A COSECANT SQUARE BEAM

[75] Inventor: Masashi Hirabe, Tokyo, Japan

[73] Assignee: NEC Corporation, Tokyo, Japan

[21] Appl. No.: 09/072,855

[22] Filed: May 5, 1998

[30] Foreign Application Priority Data

May 8, 1997 [JP] Japan ..... 9-134314

[51] Int. Cl.[7] ..... H01Q 1/38; H01Q 13/10

[52] U.S. Cl. ..... 343/700 MS; 343/771

[58] Field of Search ..... 343/770, 771, 343/731, 700 MS; H01Q 13/00, 1/38, 13/10

[56] References Cited

U.S. PATENT DOCUMENTS 3,568,208 3/1971 Hatcher et al. ..... 343/771
4,518,967 5/1985 Westerman ..... 343/771

OTHER PUBLICATIONS

H. Seki, et al., "A Wide–Angled High–XPD Node Station Antenna For Local Distribution Radio System", Proceedings of ISAP '85, Kyoto, Japan, pp. 421–424.

*Primary Examiner*—Michael C. Wimer
*Attorney, Agent, or Firm*—Ostrolenk, Faber, Gerb & Soffen, LLP

[57] ABSTRACT

To simplify designing and fabrication of a shaped beam array antenna for generating a cosecant square beam, slots having the same size are arranged with the same separation on a wall of a wave guide. The slots yield an excitation amplitude distribution wherein the excitation amplitude distribution attenuates exponentially from a feeder side of the wave guide to the terminal side of the wave guide where a terminal dummy is provided. The excitation phase distribution is linear with a slight variation. The first slot nearest to the feeder side is modified to produce an excitation phase difference between the first and the second slot.

14 Claims, 8 Drawing Sheets

SHAPED BEAM ARRAY ANTENNA FOR GENERATING A COSECANT SQUARE BEAM

BACKGROUND OF THE INVENTION

The present invention relates to a shaped beam array antenna, and particularly to that to be used in a microwave to millimeter-wave band for generating a cosecant square beam.

In a conventional shaped beam array antenna consisting of traveling-wave type array antennas, the cosecant square beam is shaped by optimizing coupling factors and locations of all antenna elements of the traveling-wave type array antenna so that a desired excitation amplitude distribution and a desired excitation phase distribution be obtained.

FIG. 8A is a perspective view illustrating an example of the conventional shaped beam array antenna and FIG. 8B is a partial magnification of FIG. 8A. In the example of FIG. 8A, the cosecant square beam is realized making use of wave-guide slot array antennas as the traveling-wave type array antennas, whereof the excitation amplitude distribution, the excitation phase distribution and the array radiation pattern are illustrated in FIGS. 9A, 9B and 9C, respectively.

Referring to FIG. 8A, the conventional shaped beam array antenna consists of a wave guide 2 and a terminal dummy 3 provided at an end of the wave guide 2. A wall of the wave guide 2 having a rectangular section is provided with a plurality (N) of slots $\mathbf{1}_1$ to $\mathbf{1}_N$ each functioning as an antenna element. In FIG. 8A, a fringe 202 provided at the other end of the wave guide 2 is further depicted together with a center line 201 of the slotted wall of the wave guide 2.

Each of the slots, an n-th slot $\mathbf{1}_n$ (n=1 to N), for example, is configured parallel to the center line 201 with each offset distance $X_n$ as shown in FIG. 8B. By controlling each offset distance $X_n$, the coupling factor of each slot $\mathbf{1}_n$ is adjusted in order to realize the desired excitation amplitude distribution such as illustrated in FIG. 9A, for example.

In the example of FIGS. 9A and 9B, the wave guide 2 has twenty slots and the element numbers 14 to 33 correspond to the slots $\mathbf{1}_1$ to $\mathbf{1}_N$ (N=20) of FIG. 8A. The element number 14 represents the slot $\mathbf{1}_1$ nearest to the fringe 202, that is, to the feeder side, while the element number 33 represents the slot $\mathbf{1}_N$ farthest from the feeder side.

Returning to FIG. 8B, the resonance length of the slot depends on its offset distance from the center line 201. Therefore, slot length $L_n$ of each slot $\mathbf{1}_n$ is prepared to be the same with the resonance length determined by each corresponding offset distance $X_n$.

Furthermore, by controlling each separation $d_n$ (n=1 to N−1) of FIG. 8B between two successive slots $\mathbf{1}_n$ and $\mathbf{1}_{n+1}$, the desired excitation phase distribution is realized such as illustrated in FIG. 9B.

By thus realizing the excitation amplitude distribution and the excitation phase distribution of FIGS. 9A and 9B, the array radiation pattern of FIG. 9C is obtained, wherein the radiation angle 90° represents an upper vertical direction towards the terminal dummy 3 of FIG. 8A and the radiation angle −90° represents a lower vertical direction towards the feeder side.

In the array radiation pattern of FIG. 9C, the cosecant square beam is obtained in an effective radiation angle range of −30° to 0°.

However, there are following problems in the conventional shaped beam array antenna as above described.

First, there are needed antenna elements capable of adjusting their coupling coefficients in a wide range for realizing the cosecant square beam. The reason is that the coupling coefficients should be high in the middle and become lower towards both ends of the antenna array in order to obtain the excitation amplitude distribution such as illustrated in FIG. 9A for generating the cosecant square beam.

Second, high precision is needed for fabricating the shaped beam array antenna. The reason is that antenna elements each having its own size a little different with each other should be ranged with separations each determined a little differently with each other in order to obtain the necessary excitation amplitude distribution and the necessary exitation phase distribution.

Third, the conventional shaped beam array antenna cannot be trimmed after once designed or fabricated. The reason is that the cosecant square beam is realized by controlling the phase and amplitude of everyone of the antenna elements, and so, effect to the array radiation pattern of the phase and amplitude of an individual antenna element cannot be specified independently.

SUMMARY OF THE INVENTION

Therefore, a primary object of the present invention is to resolve the above problems and to provide a shaped beam array antenna whereof designing and fabrication is remarkably simplified, by realizing the cosecant square beam making use of an antenna array wherein antenna elements having the same size are arranged with the same separation, except for one antenna element of the antenna array.

In order to achieve the object, the cosecant square beam is realized by designing antenna elements of a traveling-wave type array antenna so as to give an excitation amplitude distribution wherein amplitude attenuates exponentially from the feeder side to the terminal side such as illustrated in FIG. 2A, and, at the same time, so as to give an excitation phase distribution wherein excitation phase of the first antenna element is delayed substantially about 50° to 80° from that of the second antenna element and the excitation phase advances linearly a little (or remains to be the same) from the second antenna element to the last antenna element such as illustrated in FIG. 2B, or, on the contrary, so as to give another excitation phase distribution wherein excitation phase of the first antenna element is advanced substantially about 50° to 80° from that of the second antenna element and the excitation phase is delayed linearly a little (or remains to be the same) from the second antenna element to the last antenna element such as illustrated in FIG. 5B.

With such excitation amplitude distribution and such excitation phase distribution, the cosecant square beam such as illustrated in FIG. 2C or FIG. 5C is realized in the invention.

For realizing such a traveling-wave type array antenna as above described, a wavy guide is provided with slots which have the same size and are arranged with the same separation for functioning as the antenna elements. The first slot nearest to the feeder side is modified by changing its size or covering it with a dielectric film for shifting the excitation phase of the first slot by 50° to 80° from that of the other slots, in an embodiment of the invention.

The excitation phase difference of 50° to 80° between the first slot and the second slot may be realized by providing a phase shifting element in the wave guide between the first slot and the second slot.

Therefore, the shaped beam array antenna for giving the cosecant square beam can be designed and fabricated far more simply, according to the invention, than the conventional shaped beam array antenna wherein antenna elements each having its own size a little different with each other should be arranged with separations each determined a little differently with each other.

Furthermore, in the shaped beam array antenna according to the invention, the excitation amplitude of each antenna element is sufficient to be attenuated expornentially from the feeder side to the terminal side of the traveling-wave type array antenna. Hence, it is not necessary to use antenna elements whereof the coupling coefficient can be controlled to widely.

Therefore, the shaped beam array antenna for giving the cosecant a square beam can be also realized, according to the invention, making use of other appropriate array antennae, such as a micro-strip array antenna, for example, as the traveling-wave type array antenna in accordance with other designing factor, not limited in the wave-guide slot-array antenna.

BRIEF DESCRIPTION OF THE DRAWINGS

The foregoing, further objects, features, and advantages of this invention will become apparent from a consideration of the following description, the appended claims, and the accompanying drawings wherein the same numerals indicate the same or the corresponding parts.

In the drawings.

DETAILED DESCRIPTION OF THE PREFERRED EMBODIMENTS

Now, embodiments of the present invention will be described in connection with the drawings.

Figure 1A:
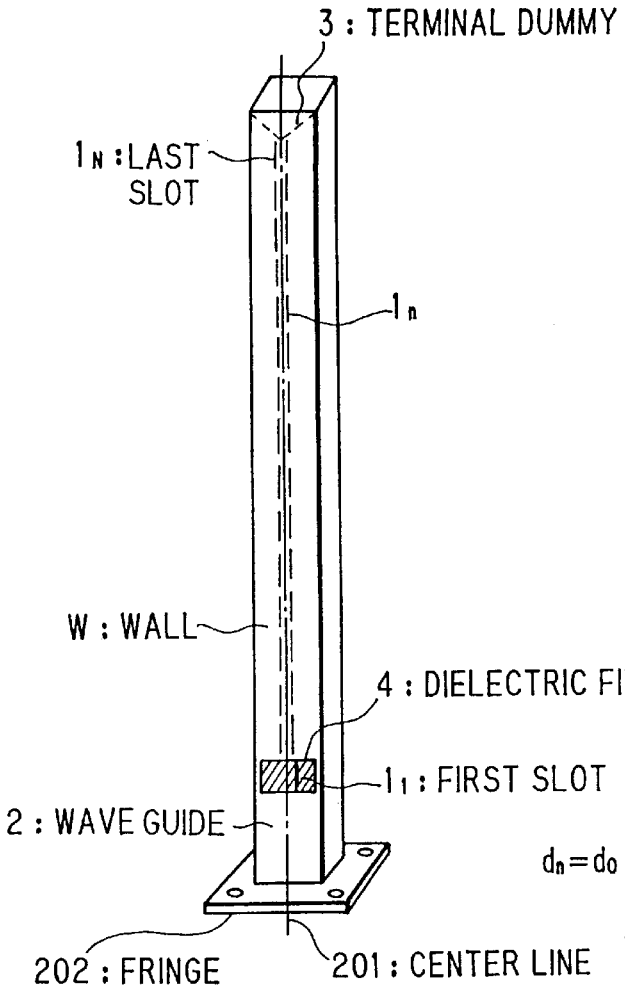
FIG. 1A is a perspective view illustrating a shaped beam array antenna according to a first embodiment of the invention.
Figure 1B:
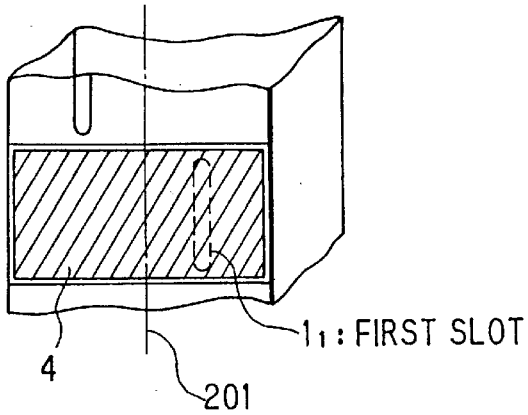
FIG. 1B is a partial magnification of the shaped beam array antenna of FIG. 1A.
Figure 1C:
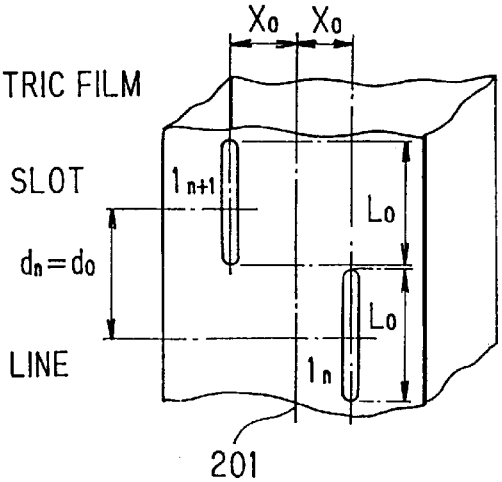
FIG. 1C is another partial magnification of the shaped beam array antenna of FIG 1A.

FIG. 1A is a perspective view illustrating a shaped beam array antenna according to a first embodiment of the invention making use of a wave-guide slot-array antenna, whereof partial magnifications are illustrated in FIGS. 1B and 1C.

The shaped beam array antenna of FIG. 1A comprises a wave guide 2 whereof a wall W is provided with a first to an N-th slot $\mathbf{1}_1$ to $\mathbf{1}_N$, a terminal dummy 3 provided at a terminal end of the wave guide 2, and a dielectric film 4 which covers the first slot $\mathbf{1}_1$. Each of the first to the N-th slot $\mathbf{1}_1$ to $\mathbf{1}_N$ has the same pattern of the same size, and is arranged along a center line 201 of the wall W alternately at left side and right side with the same offset distance $X_0$. Therefore, the resonance length is the same at each slot, and accordingly, each of the first to the N-th slot $\mathbf{1}_1$ to $\mathbf{1}_N$ has the same resonance length $L_0$ determined by the offset length $X_0$, as shown in FIG. 1C.

Further, the first to the N-th slot $\mathbf{1}_1$ to $\mathbf{1}_N$ are arranged with the same separation, that is, the difference $d_n$ of center coordinates in the direction of the center line 201 between the n-th slot $\mathbf{1}_n$ and the (n+1)-th slot $\mathbf{1}_{n+1}$ is designed to be $d_n=d_0$ ($\neq\lambda g/2$ according to the condition of the traveling-wave type array antenna, $\lambda g$ being a wave length in the wave guide) for every n=1 to N−1.

Thus preparing the wave guide 2, the first slot $\mathbf{1}_1$ nearest to the feeder side, that is, to a fringe 202, is covered with the dielectric film 4, in the first embodiment. Covered with the dielectric film 4, the resonance frequency of the first slot $\mathbf{1}_1$ becomes a little lower than that of other slots $\mathbf{1}_2$ to $\mathbf{1}_N$, and the excitation phase of the first slot $\mathbf{1}_1$ is made a little delayed (substantially about −50° to −80°) from the excitation phase of the other slots $\mathbf{1}_2$ to $\mathbf{1}_N$ because of the difference of the susceptance component.

Figure 2A:
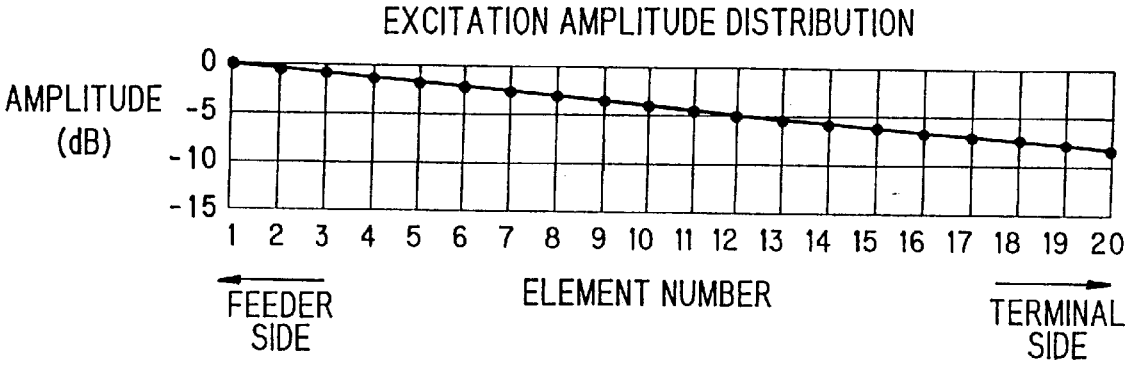
FIG. 2A is a graphic chart illustrating an excitation amplitude distribution obtained by the first embodiment of FIG. 1A.
Figure 2B:
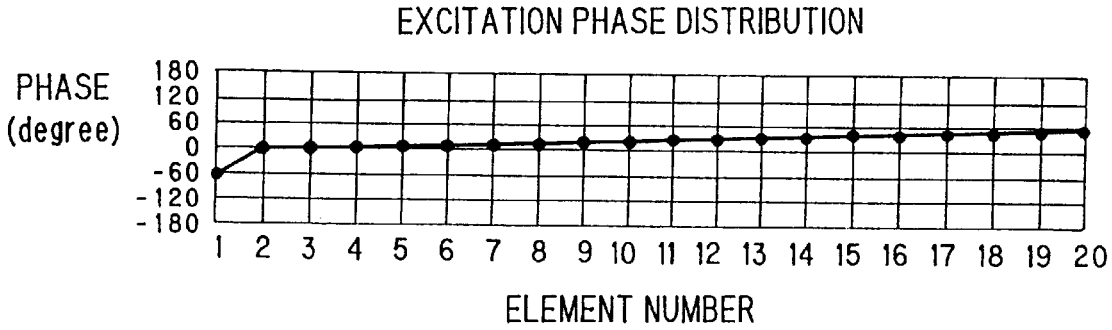
FIG. 2B is a graphic chart illustrating an excitation phase distribution obtain by the first embodiment of FIG. 1A.

FIGS. 2A and 2B are graphic charts illustrating the excitation amplitude distribution and the excitation phase distribution obtained by the first embodiment of FIG. 1A, respectively, wherein the element numbers 1 to 20 correspond to the first to the N-th slot $\mathbf{1}_1$ to $\mathbf{1}_N$ of FIG. 1A.

As shown in FIGS. 2A and 2B, the excitation amplitude distribution attenuates exponentially from the feeder side to the terminal side. The excitation phase of the first antenna element is delayed substantially about 50° to 80° from that of the second antenna element. The excitation phase advances linearly a little (or remains the same) from the second antenna element to the last antenna element.

Figure 2C:
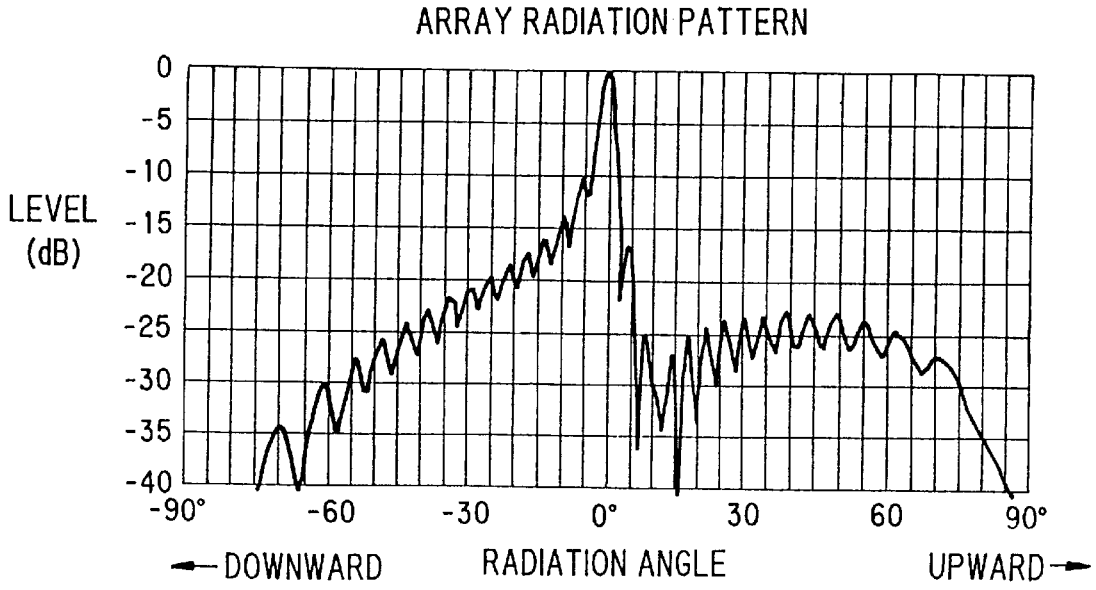
FIG. 2C is a graphic chart illustrating an array radiation pattern obtained by the embodiment of FIG. 1A.

With this excitation amplitude distribution and the excitation phase distribution, an array radiation pattern illustrated in FIG. 2C is generated, wherein the cosecant square beam is obtained in an effective range from −30° to 0° in elevation.

Figure 3:
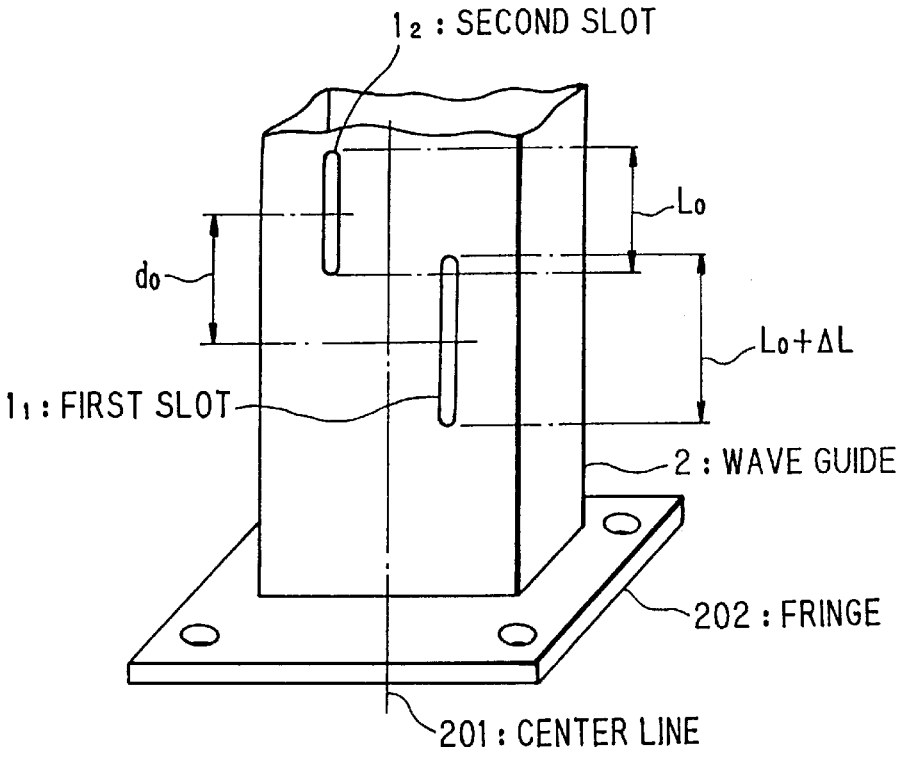
FIG. 3 is a partial perspective view illustrating a second embodiment of the invention.

FIG. 3 is a partial perspective view illustrating a second embodiment of the invention, corresponding to FIG. 1B of the first embodiment. In the first embodiment, the first slot $\mathbf{1}_1$ is covered with the dielectric film 4 for shifting the resonance frequency thereof. Instead of covering the first slot $1_1$ with the dielectric film 4, the length of the first slot $1_1$ is changed to be a little (ΔL) longer than that of the other slots $1_2$ to $1_N$, that is, than the resonance length $L_0$, in the second embodiment. Other components are the same with the fist embodiment of FIG. 1A.

By changing the slot length to be a little longer, the resonance frequency becomes a little lower than that of other slots $1_2$ to $1_N$, which makes the excitation phase of the first slot $1_1$ a little delayed from the excitation phase of the other slots $1_2$ to $1_N$, in the same way with the first embodiment. The value of the length difference ΔL is to be determined according to desired phase difference (substantially about −50° to −80°).

With the second embodiment of FIG. 3, substantially the same excitation amplitude distribution, the same excitation phase distribution and the same array radiation pattern with those of the first embodiment such as illustrated in FIGS. 2A to 2C are obtained.

In the first and the second embodiment, the excitation phase of the first slot $1_1$ is a little delayed from that of the other slots $1_2$ to $1_N$. However, conversely it may be a little advanced.

Figure 4:
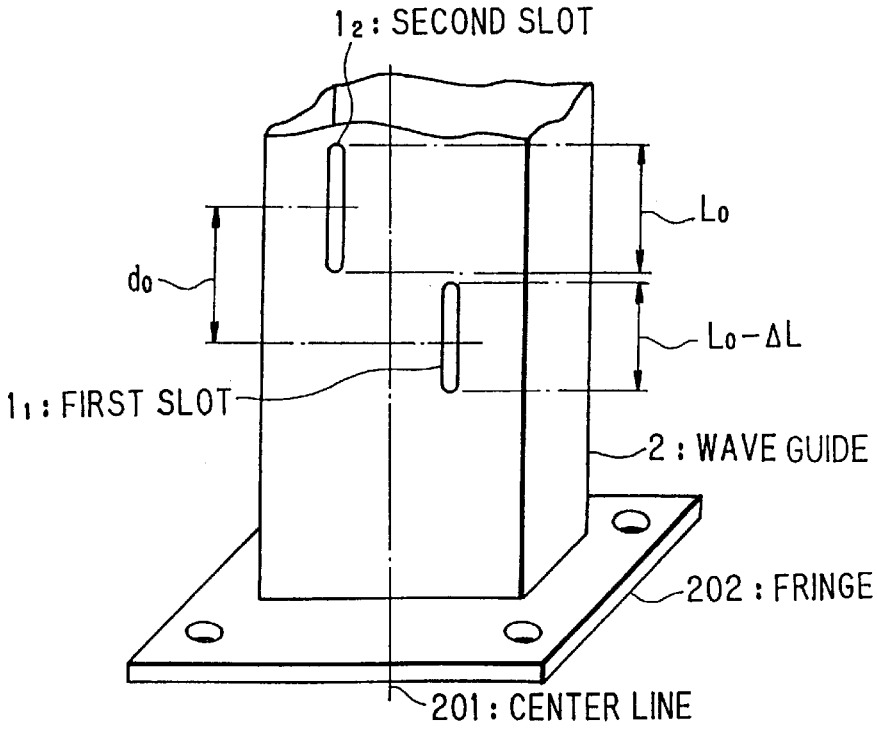
FIG. 4 is a partial perspective view illustrating a third embodiment of the invention.

FIG. 4 is a partial perspective view illustrating a third embodiment of the invention. The only difference of the third embodiment compared to the second embodiment is that the length of the first slot $1_1$ is changed to be a little (ΔL) shorter than that ($L_0$) of the other slots $1_2$ to $1_N$, as shown in FIG. 4.

Figure 5A:
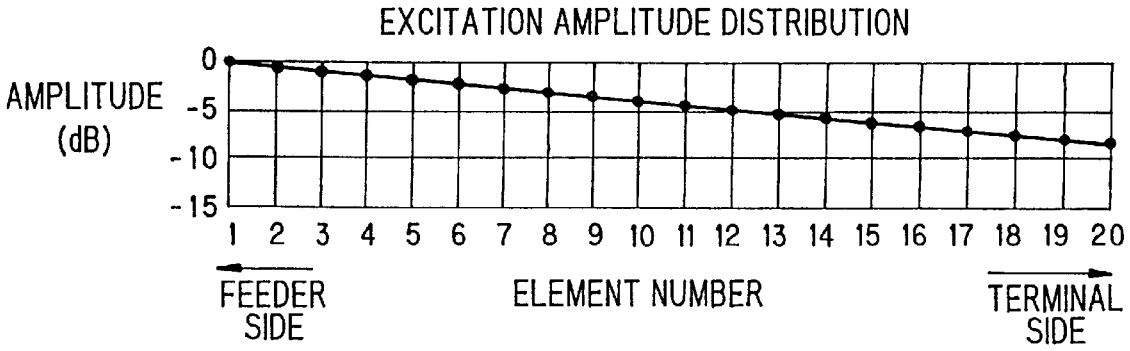
FIG. 5A is a graphic chart illustrating an excitation amplitude distribution obtained by the third embodiment of FIG. 4.
Figure 5B:
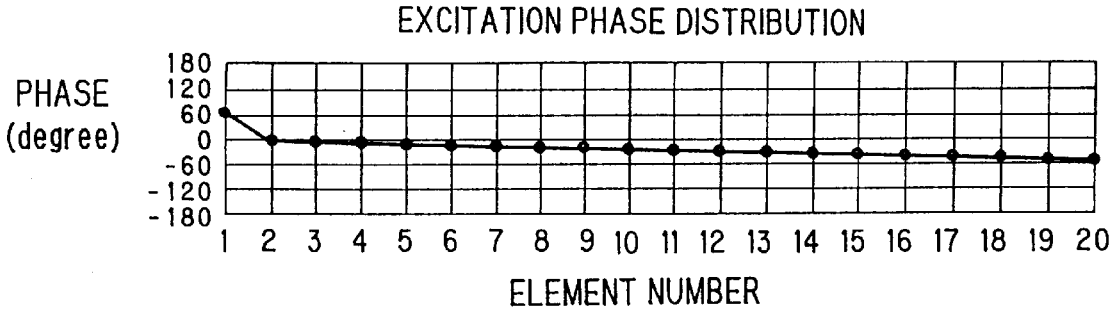
FIG. 5B is a graphic chart illustrating an excitation phase distribution obtain by the third embodiment of FIG. 4.

By making the length of the first slot $1_1$ a little shorter so as to make the excitation phase of the first slot $1_1$ a little (substantially +50° to +80°) advanced from that of the other slots $1_2$ to $1_N$, and adjusting the separation $d_0$ between each successive two slot, an excitation amplitude distribution as illustrated in FIG. 5A, which is substantially the same with that of FIG. 2A, and excitation phase distribution as illustrated in FIG. 5B is obtained. Here, the excitation phase of the first antenna element is advanced substantially about 50° to 80° from that of the second antenna excitation phase is delayed linearly a little (or remains to be the same) from the second antenna element to the last antenna element.

Figure 5C:
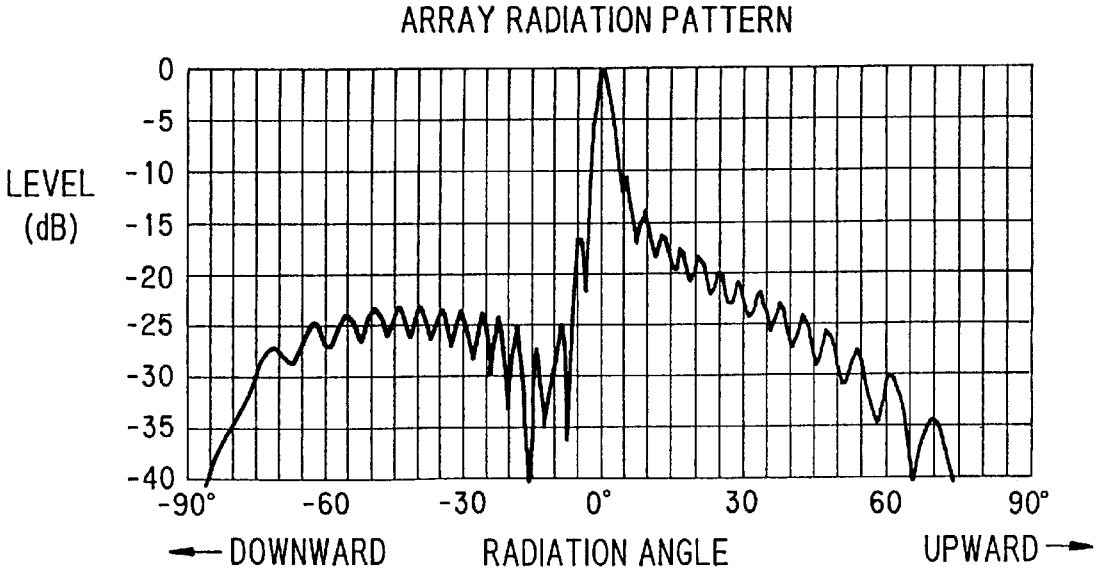
FIG. 5C is a graphic chart illustrating an array radiation pattern obtained by the third embodiment of FIG. 4.

With this excitation amplitude distribution and the excitation phase distribution, an array radiation pattern illustrated in FIG. 5C is generated, wherein the cosecant square beam is obtained in an effective range from 0° to 30° in elevation, inversely to the array radiation pattern of FIG. 2C.

The necessary excitation phase shift between the first slot $1_1$ and the second slot $1_2$ may be obtained by providing a phase shifting element in the wave guide 2, for example, instead of shifting the resonance frequency of the first slot $1_1$.

Figure 6:
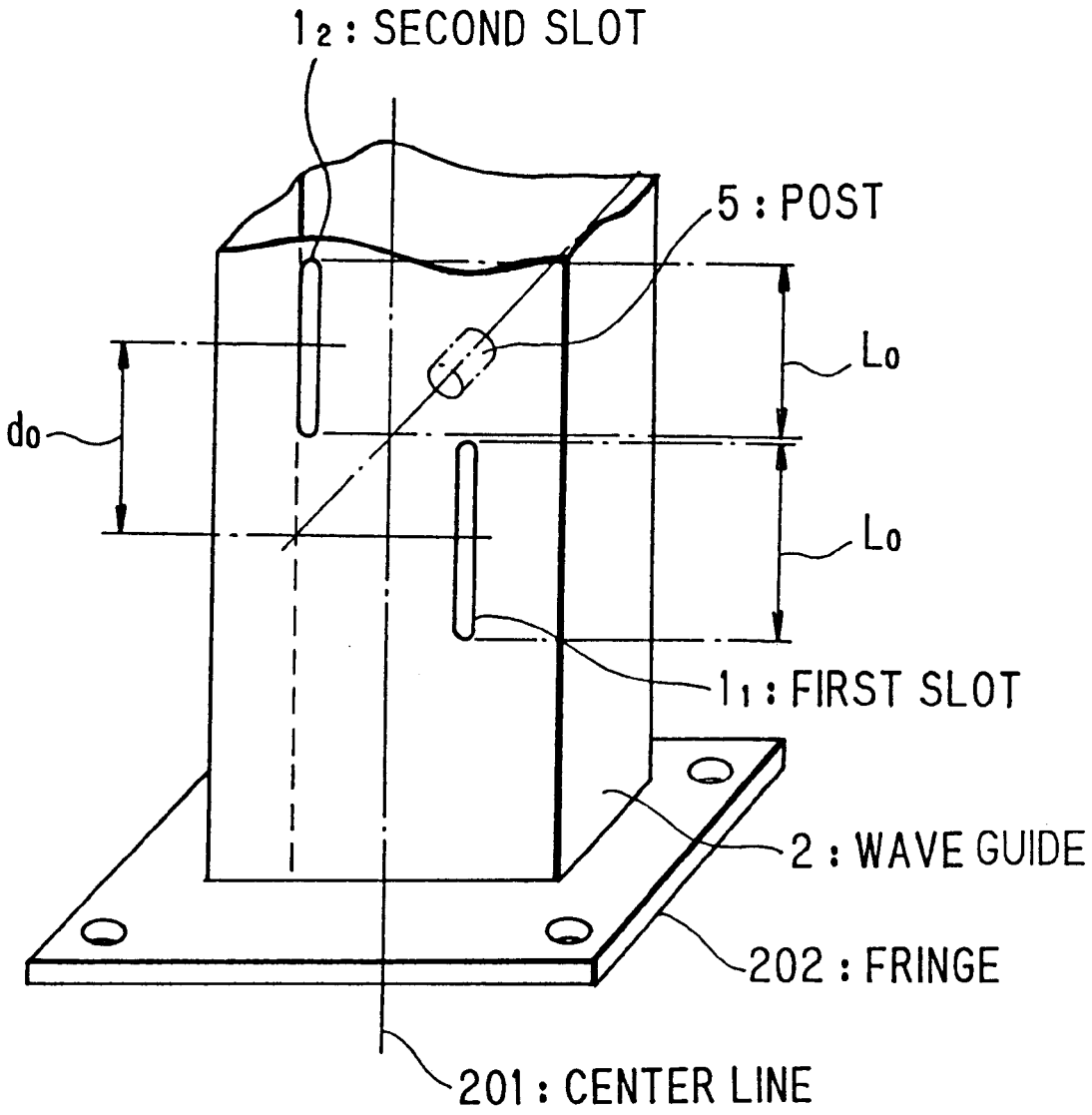
FIG. 6 is a partial perspective view of a fourth embodiment of the invention.

FIG. 6 is a partial perspective view of a fourth embodiment of the invention, wherein a post 5 is provided instead of the dielectric film 4 of the first embodiment of FIG. 1B, between the second slot $1_2$ and the first slot $1_1$ having the same length with the other slots $1_2$ to $1_N$.

In the fourth embodiment, a metal screw is applied as the post 5, which is engaged in a wall facing to the wall W having the slots so as to be positioned vertically to the center point of the first slot $1_1$ and the second slot $1_2$ and capable for adjusting the distance from the top of the post 5 and the center point, as shown in FIG. 6.

With the fourth embodiment, the excitation amplitude distribution, the excitation phase distribution and the array radiation pattern substantially the same with those of FIGS. 2A to 2C are obtained.

As previously described, the shaped beam array antenna for generating the cosecant square beam can be realized with array antennae having the same coupling coefficient. Therefore, other type array antennae may be applied in the invention.

Figure 7A:
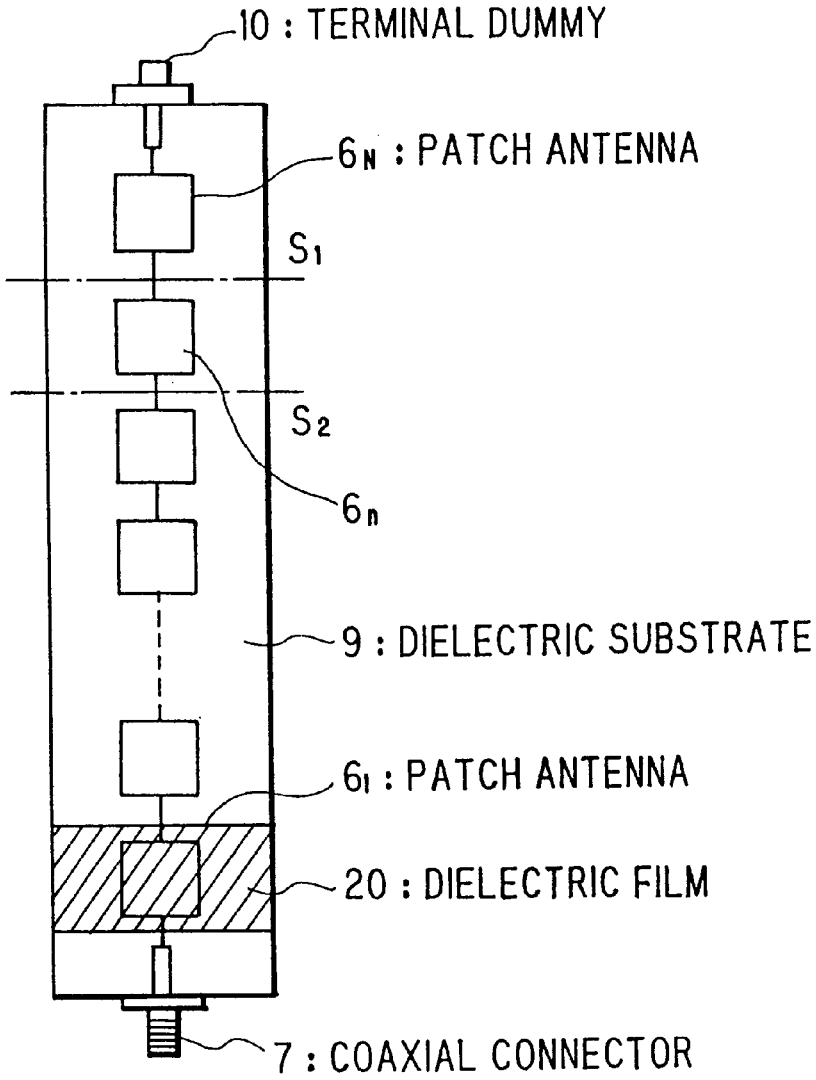
FIG. 7A is a front view illustrating a fifth embodiment of the invention.
Figure 7B:
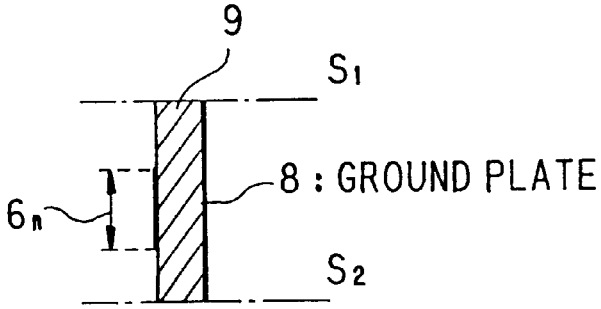
FIG. 7B is a partial side view illustrating a section of the microstrip antenna of FIG. 7A between planes S1 to S2.
Figure 8A:
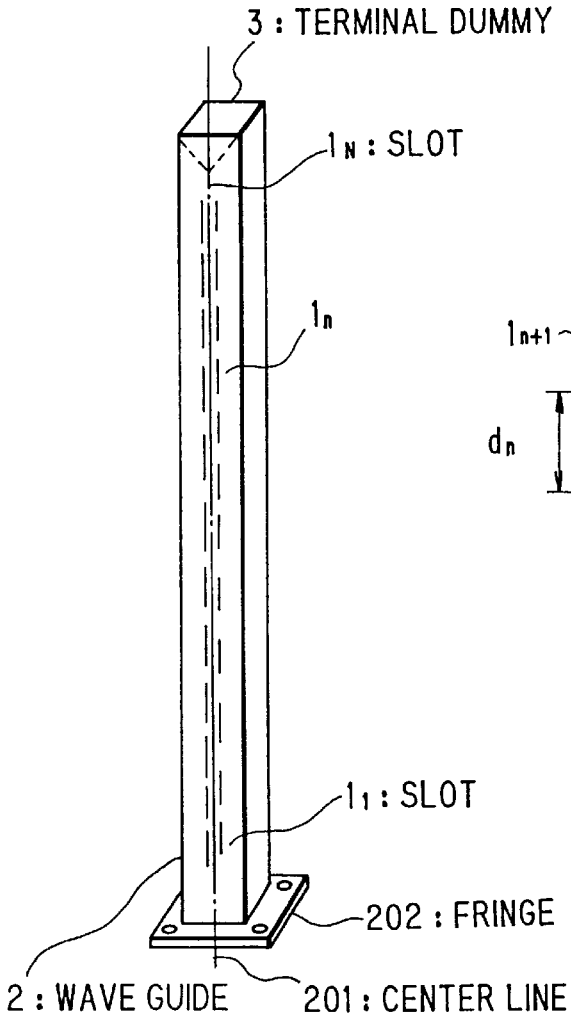
FIG. 8A PRIOR ART
FIG. 8A is a perspective view illustrating an example of the conventional shaped beam array antenna.
Figure 8B:
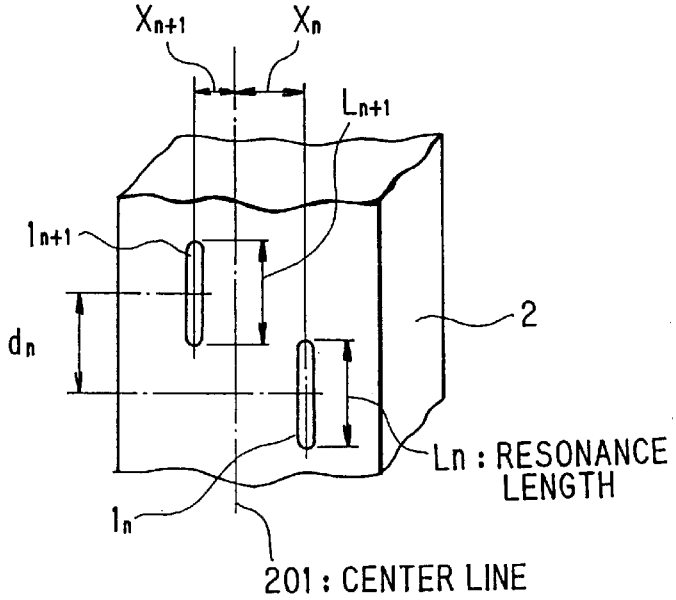
FIG. 8B PRIOR ART
FIG. 8B is a partial magnification of FIG. 8A.
Figure 9A:
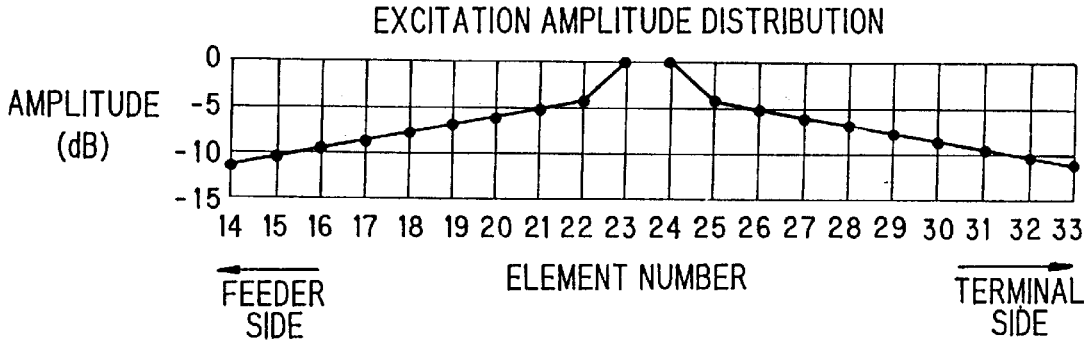
FIG. 9A PRIOR ART
FIG. 9A is a graphic chart illustrating an excitation amplitude distribution obtained by the conventional shaped beam array antenna of FIG. 8A.
Figure 9B:
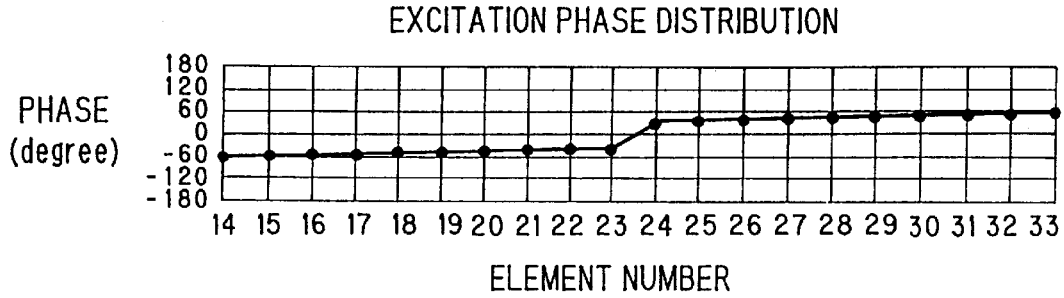
FIG. 9B PRIOR ART
FIG. 9B is a graphic chart illustrating an excitation phase distribution obtained by he conventional shaped beam array antenna of FIG. 8A.
Figure 9C:
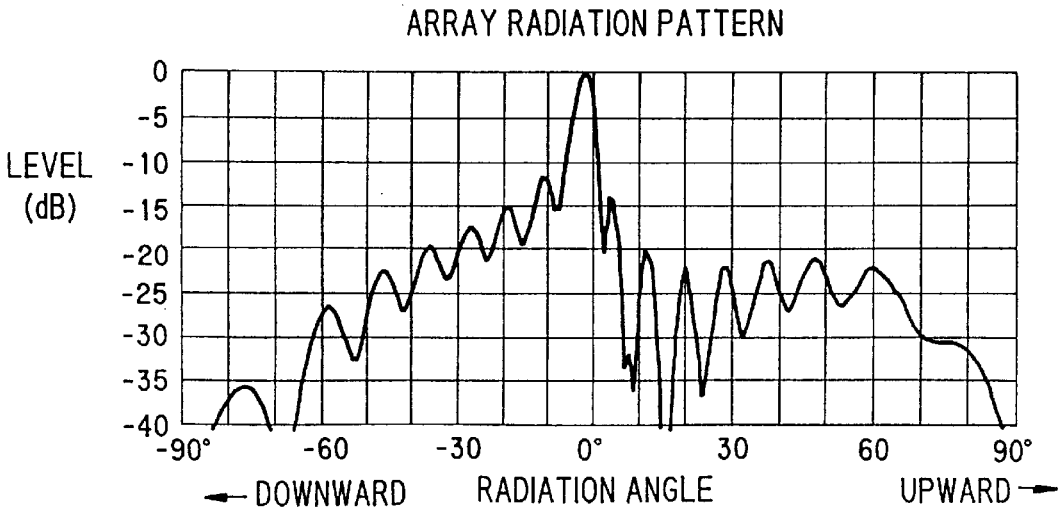
FIG. 9C PRIOR ART
FIG. 9C is a graphic chart illustrating an array radiation pattern obtained by the conventional shaped beam array antenna of FIG. 8A.

FIG. 7A is a front view illustrating a fifth embodiment of the invention, wherein a micro-strip antenna is used as the traveling wave type antenna. FIG. 7B is a partial side view illustrating a section of the micro-strip antenna of FIG. 7A between planes S1 to S2.

Referring to FIGS. 7A and 7B, the micro-strip antenna comprises a dielectric substrate 9, a ground plate 8 provided at the back of the dielectric substrate 9 made of a copper foil, a first to an N-th patch antenna ranged on the front of the dielectric substrate 9, a feeder coaxial connector 7 connected to the first patch antenna $6_1$ and the ground plate 8 at the feeder end of the micro-strip antenna, a terminal dummy 10 connected to the last patch antenna $6_N$ and the ground plate 8 at the terminal end of the micro-strip antenna, and a dielectric film 20 for covering the first patch antenna $6_1$ nearest to the feeder coaxial connector 7.

Each of the first to the N-th patch antennas $6_1$ to $6_N$ functions in the same way as each of the first to the N-th slot antenna $1_1$ to $1_N$ of the first embodiment of FIG. 1A, giving the same excitation amplitude distribution and the same excitation phase distribution, and consequently, the same array radiation pattern such as those illustrated in FIGS. 2A to 2C, respectively.

As heretofore described, in the shaped beam array antenna of the invention, the cosecant square beam is realized by a traveling-wave type antenna giving an excitation amplitude distribution wherein the amplitude attenuates expornentially from the feeder side to the terminal side, and an excitation phase distribution wherein the excitation phase varies linearly by a certain rate except between the first and the second antenna element.

Therefore, a merit of the shaped beam array antenna of the invention is that it is not necessary to use antenna elements whereof coupling coefficient can be controlled widely, for realizing the cosecant square beam.

Another merit is that it can be designed and fabricated easily, since it can be composed of antenna elements all having the same size. The necessary excitation phase difference between the first and the second antenna element can be easily obtained by modifying the first antenna element or providing a phase shifting element between the first and the second antenna element.

Still another merit is that it can be easily trimmed even after the fabrication, since the array radiation pattern of the invention is defined by two parameters, that is, the phase difference between the first and the second antenna element and the coupling coefficient which is the same for all the antenna elements.

What is claimed is:

1. A shaped beam array antenna for generating a cosecant square beam, said shaped beam array antenna comprising:

a wave guide including a plurality of slots having the same size and arranged along walls of the wave guide, each slot being separated from a next slot by the same distance;

wherein each of the plurality of slots functions as an antenna element of the array antenna yielding an excitation amplitude distribution attenuating from a feeder side of the wave guide to a terminal side of the wave guide; and wherein said wave guide further includes an additional slot formed in one of said walls of said wave guide at a location nearer to the feeder side than any of said plurality of slots, the additional slot producing an excitation phase difference between the additional slot and a first of the plurality of slots.

2. The shaped beam array antenna recited in claim 1, wherein the additional slot comprises an opening in said wall of said wave guide covered with a dielectric film.

3. The shaped beam array antenna recited in claim 1, wherein the slot length of the additional slot is distinct from the slot length of each of the plurality of slots.

4. The shaped beam array antenna as claimed in claim 1, wherein:

said wave guide has a center line; and all of said slots have a longitudinal axis which is disposed at the same distance from said center line.

5. A shaped beam array antenna for generating a cosecant square beam, said shaped beam array antenna comprising:

a wave guide including a plurality of slots having the same size and arranged along walls of the wave guide, each slot being separated from a next slot by the same distance;

wherein each of the plurality of slots functions as an antenna element of the array antenna yielding an excitation amplitude distribution attenuating from a feeder side of the wave guide to a terminal side of the wave guide; and a phase shifting element located in the wave guide between an additional slot formed in one of said walls of said wave guide at a location nearer to the feeder side than any of the plurality of slots, and a first of the plurality of slots, the phase shifting element producing an excitation phase difference between the additional slot and the first of the plurality of slots.

6. The shaped beam array antenna as claimed in claim 5, wherein:

said wave guide has a center line; and all of said slots have a longitudinal axis which is disposed at the same distance from said center line.

7. A shaped beam array antenna for generating a cosecant square beam, said shaped beam array antenna comprising:

a micro-strip array antenna including a plurality of patch antennas having the same size and arranged on a dielectric substrate of the micro-strip antenna, each patch antenna being separated from a next patch antenna by the same distance;

wherein each of the plurality of patch antennas functions as an antenna element of the array antenna producing an excitation amplitude distribution attenuating from a feeder side of the micro-strip antenna to a terminal side of the micro-strip antenna; and wherein the micro-strip array further includes an additional patch antenna formed in said dielectric substrate at a location nearer to the feeder side than any of said plurality of patch antennas, the additional patch antenna producing an excitation phase difference between the additional patch antenna and the first of the plurality of patch antennas.

8. The shaped beam array antenna as claimed in claim 7, wherein said additional patch antenna is covered by a dielectric film.

9. The shaped beam array antenna as claimed in claim 7, wherein:

said micro-strip array antenna has a center line; and all of said patch antennas have a longitudinal axis which is disposed at the same distance from said center line.

10. A shaped beam array antenna comprising:

a wave guide including a plurality of slots, each slot having the same size and being arranged along walls of said wave guide, said wave guide having a center line, each slot having a longitudinal axis disposed at the same distance from said center line;

said wave guide further including an additional slot disposed said same distance from said center line and being disposed at one end of said wave guide, said additional slot being designed so as to produce an excitation phase difference between said additional slot and an adjacent one of said plurality of slots.

11. The shaped beam array antenna as claimed in claim 10, further comprising a dielectric film covering said additional slot.

12. The shaped beam array antenna as claimed in claim 10, wherein a slot length of said additional slot is distinct from a slot length of each one of said plurality of slots.

13. The shaped beam array antenna as claimed in claim 10, further comprising a phase shifting element disposed in said wave guide between said additional slot and said plurality of slots.

14. The shaped beam array antenna as claimed in claim 10, wherein all of said slots are the same size and shape.

* * * * *